US009389531B2

(12) United States Patent
Suzuki

(10) Patent No.: US 9,389,531 B2
(45) Date of Patent: Jul. 12, 2016

(54) IMAGE FORMING APPARATUS INCLUDING DRIVE SWITCHING MECHANISM TO CONTROL TRANSMISSION OF DRIVING FORCE

(71) Applicant: Yasuhiro Suzuki, Nagoya (JP)

(72) Inventor: Yasuhiro Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 150 days.

(21) Appl. No.: 14/197,244

(22) Filed: Mar. 5, 2014

(65) Prior Publication Data

US 2014/0251755 A1 Sep. 11, 2014

(30) Foreign Application Priority Data

Mar. 5, 2013 (JP) ..... 2013-042773

(51) Int. Cl.

| | |
|---|---|
| ***G03G 15/00*** | (2006.01) |
| ***G03G 15/01*** | (2006.01) |
| ***G03G 21/16*** | (2006.01) |
| *G03G 15/08* | (2006.01) |

(52) U.S. Cl.

CPC ..... *G03G 15/0126* (2013.01); *G03G 21/1647* (2013.01); *G03G 15/0194* (2013.01); *G03G 15/0806* (2013.01); *G03G 2221/1657* (2013.01)

(58) Field of Classification Search

CPC ..... G03G 15/0126; G03G 15/0194; G03G 15/0806; G03G 21/1647; G03G 2221/1657; B65G 13/06

USPC ..... 399/167

See application file for complete search history.

(56) References Cited

U.S. PATENT DOCUMENTS

| | | | | |
|---|---|---|---|---|
| 7,526,232 | B2 | 4/2009 | Kamimura et al. | |
| 2007/0053719 | A1 | 3/2007 | Kamimura et al. | |
| 2008/0226345 | A1* | 9/2008 | Yoon | G03G 21/1676 399/167 |
| 2009/0035019 | A1* | 2/2009 | Koga | B41J 2/16547 399/167 |

FOREIGN PATENT DOCUMENTS

| | | | |
|---|---|---|---|
| JP | 2000-293003 | A | 10/2000 |
| JP | 2007-072021 | A | 3/2007 |

* cited by examiner

*Primary Examiner* — Billy Lactaoen

(74) *Attorney, Agent, or Firm* — Banner & Witcoff, Ltd.

(57) ABSTRACT

An image forming apparatus is provided that includes a first transmission mechanism transmitting a driving force from a driving source to a first development roller, a second transmission mechanism transmitting the driving force from the driving source to a second development roller, and a drive switching mechanism disposed between the driving source and the first transmission mechanism and between the driving source and the second transmission mechanism, the drive switching mechanism including a switching gear movable along a rotational axis direction of the first development roller, between a first position to transmit the driving force to the first transmission mechanism and the second transmission mechanism, and a second position to restrict the driving force from being transmitted from the driving source to the first transmission mechanism and allow the driving force to be transmitted from the driving source to the second transmission mechanism.

15 Claims, 8 Drawing Sheets

FIG. 6A
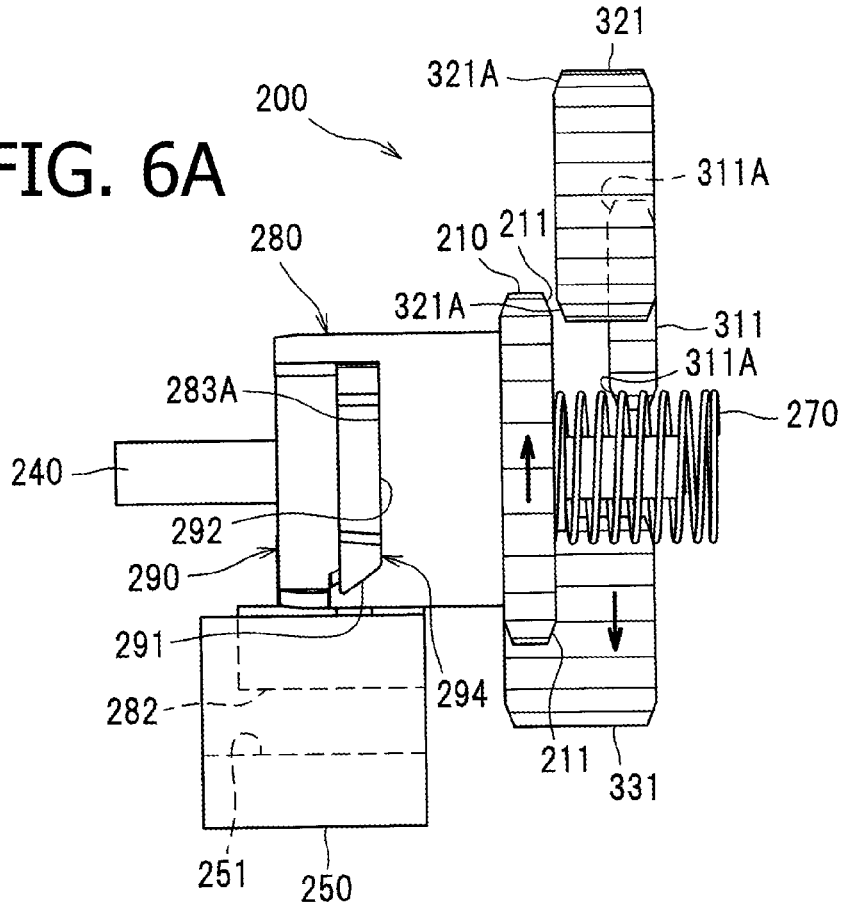
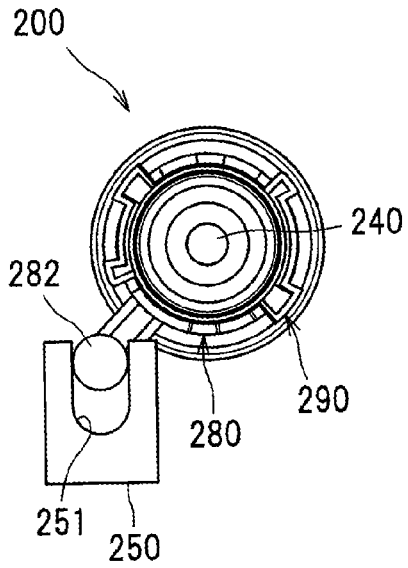
FIG. 6B
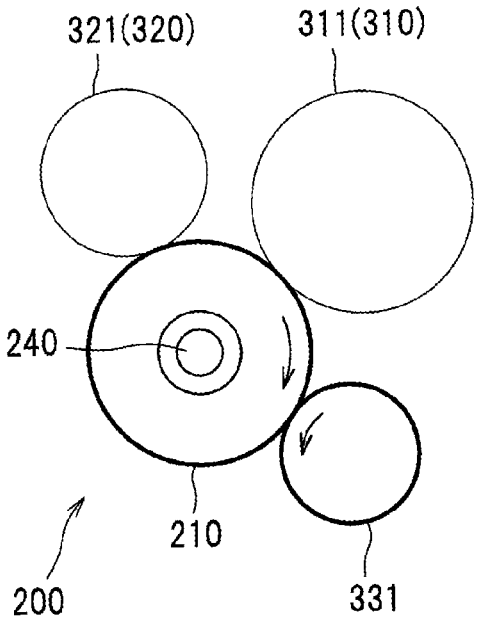
FIG. 6C

FIG. 7A
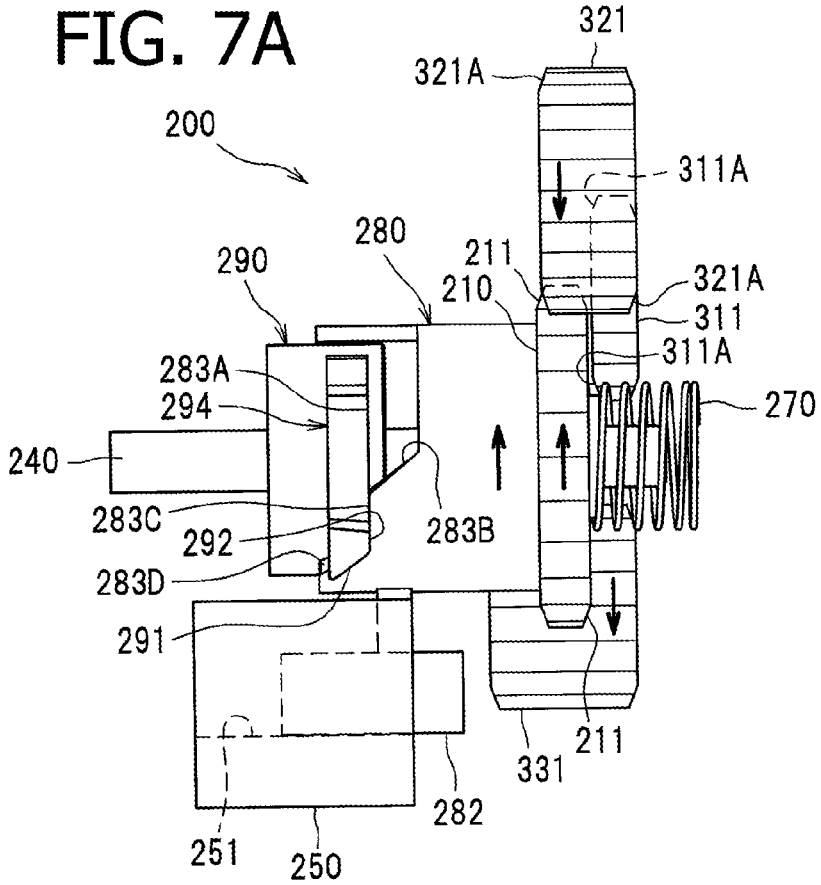
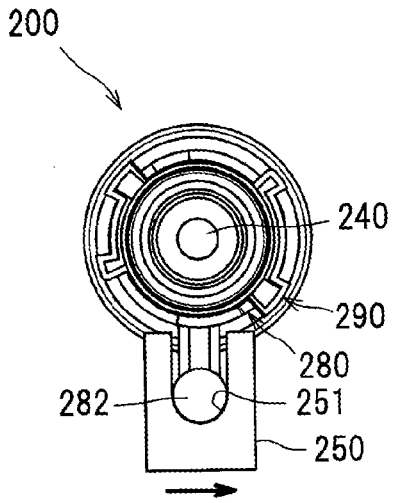
FIG. 7B
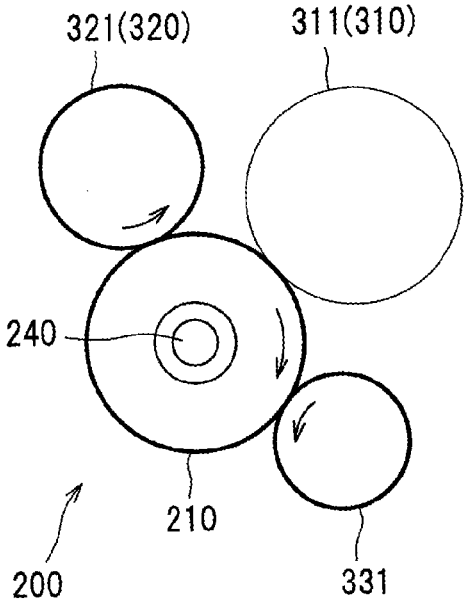
FIG. 7C

FIG. 8A
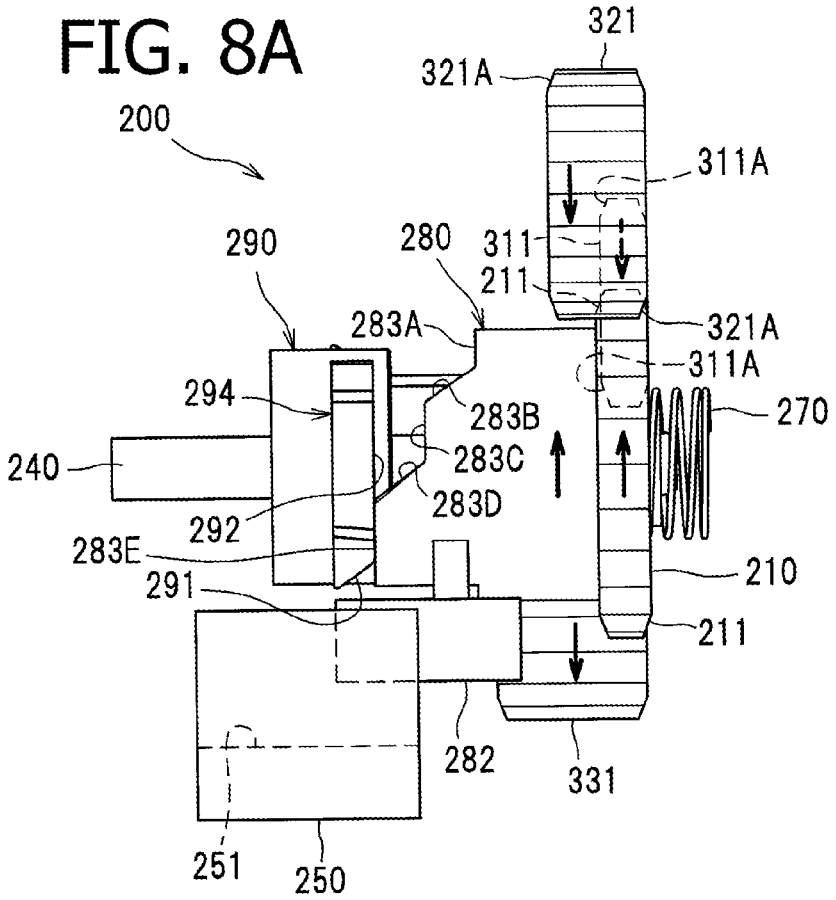
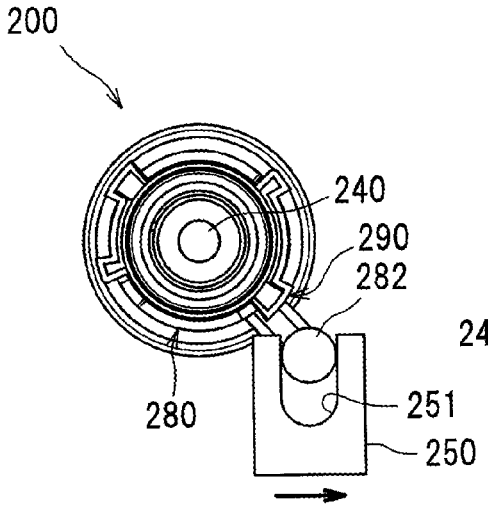
FIG. 8B
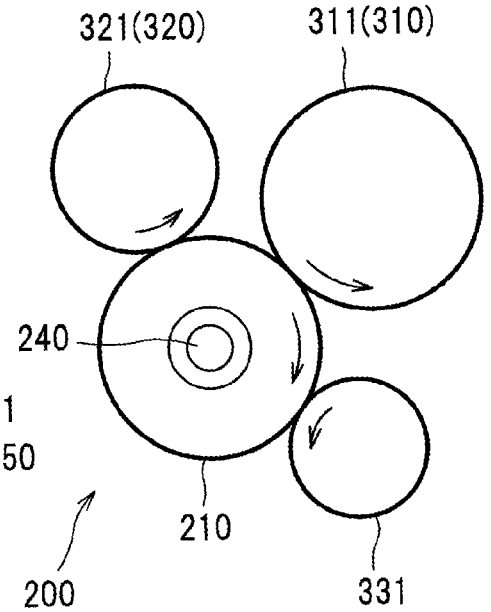
FIG. 8C

IMAGE FORMING APPARATUS INCLUDING DRIVE SWITCHING MECHANISM TO CONTROL TRANSMISSION OF DRIVING FORCE

CROSS-REFERENCE TO RELATED APPLICATION

This application claims priority under 35 U.S.C. §119 from Japanese Patent Application No. 2013-042773 filed on Mar. 5, 2013. The entire subject matter of the application is incorporated herein by reference.

BACKGROUND

1. Technical Field

The following description relates to one or more techniques for an image forming apparatus configured to print a monochrome image and a color image on a sheet.

2. Related Art

An image forming apparatus has been known that is configured to switch between a monochrome state and a color state. In the monochrome state, a driving force is transmitted from a driving source (such as a motor) only to a development roller for black. In the color state, the driving force is transmitted from the driving force to development rollers for all colors that include the development roller for black. Specifically, the image forming apparatus includes a first gear mechanism and a second gear mechanism that are configured to transmit the driving force from the motor to the development roller for black, a third gear mechanism configured to transmit the driving force from the motor to the other development rollers for colors other than black, and a swing gear configured to swing in response to a rotational direction of the motor being switched.

Then, the image forming apparatus is configured to switch between a monochrome mode and a color mode by switching between a first engagement state and a second engagement state. In the first engagement state, the swing gear, after swinging in a first direction, engages only with the first gear mechanism. In the second engagement state, the swing gear, after swinging in a second direction, engages with the second gear mechanism and the third gear mechanism.

SUMMARY

However, in the known image forming apparatus, the rotational direction of the motor has to be changed in order to switch between the monochrome mode and the color mode. Therefore, it is difficult to use the motor, which is used for driving the development rollers, in common for driving other mechanisms.

Aspects of the present invention are advantageous to provide one or more improved techniques, for an image forming apparatus, which make it possible to use a driving source, used for driving development rollers, in common for driving other mechanisms.

According to aspects of the present invention, an image forming apparatus is provided, which includes a first development roller configured to carry development agent of a first color, a second development roller configured to carry development agent of a second color, a driving source, a first transmission mechanism configured to transmit a driving force from the driving source to the first development roller, a second transmission mechanism configured to transmit the driving force from the driving source to the second development roller, and a drive switching mechanism disposed between the driving source and the first transmission mechanism and between the driving source and the second transmission mechanism, the drive switching mechanism including a switching gear configured to move along a rotational axis direction of the first development roller, between a first position to transmit the driving force to the first transmission mechanism and the second transmission mechanism, and a second position to restrict the driving force from being transmitted from the driving source to the first transmission mechanism and allow the driving force to be transmitted from the driving source to the second transmission mechanism.

According to aspects of the present invention, further provided is an image forming apparatus including a first development roller configured to carry development agent of a first color, a second development roller configured to carry development agent of a second color, a driving source, a first gear configured to transmit a driving force from the driving source to the first development roller, a second gear configured to transmit the driving force from the driving source to the second development roller, and a switching gear configured to move along a rotational axis direction of the first development roller between a first position to engage the switching gear with the first gear and the second gear, and a second position to engage the switching gear with the second gear and disengage the switching gear from the first gear.

BRIEF DESCRIPTION OF THE ACCOMPANYING DRAWINGS

FIG. 1 is a cross-sectional side view schematically showing an internal configuration of a color printer in an embodiment according to one or more aspects of the present invention.

FIG. 2 schematically shows contact states and separated states between photoconductive drums and development rollers of the color printer in the embodiment according to one or more aspects of the present invention.

FIG. 3 schematically shows a transmission system for transmitting a driving force from a motor to the development rollers in the embodiment according to one or more aspects of the present invention.

FIG. 6A is a front view of the drive switching mechanism when a switching gear is in an all-separated position in the embodiment according to one or more aspects of the present invention.

FIG. 6B schematically shows a back-and-forth movable member when the switching gear is in the all-separated position in the embodiment according to one or more aspects of the present invention.

FIG. 6C schematically shows transmission of the driving force when the switching gear is in the all-separated position in the embodiment according to one or more aspects of the present invention.

FIG. 7A is a front view of the drive switching mechanism when the switching gear is in a monochrome position in the embodiment according to one or more aspects of the present invention.

FIG. 7B schematically shows the back-and-forth movable member when the switching gear is in the monochrome position in the embodiment according to one or more aspects of the present invention.

FIG. 7C schematically shows transmission of the driving force when the switching gear is in the monochrome position in the embodiment according to one or more aspects of the present invention.

FIG. 8A is a front view of the drive switching mechanism when the switching gear is in a color position in the embodiment according to one or more aspects of the present invention.

FIG. 8B schematically shows the back-and-forth movable member when the switching gear is in the color position in the embodiment according to one or more aspects of the present invention.

FIG. 8C schematically shows transmission of the driving force when the switching gear is in the color position in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompanying drawings. It is noted that, in the embodiment, aspects of the present invention are applied to a color printer. Further, in the following descriptions, a front side, a rear side, an upside, and a downside of the color printer will be defined as shown in relevant drawings. Moreover, in the following descriptions, a left side and a right side of the color printer will be defined as the left side and the right side in the front view of the color printer, respectively (namely, the left side and the right side of the color printer will be defined as the far side and the near side with respect to a sheet surface of each relevant drawing, respectively).

<Overall Configuration of Color Printer>

Figure 1:
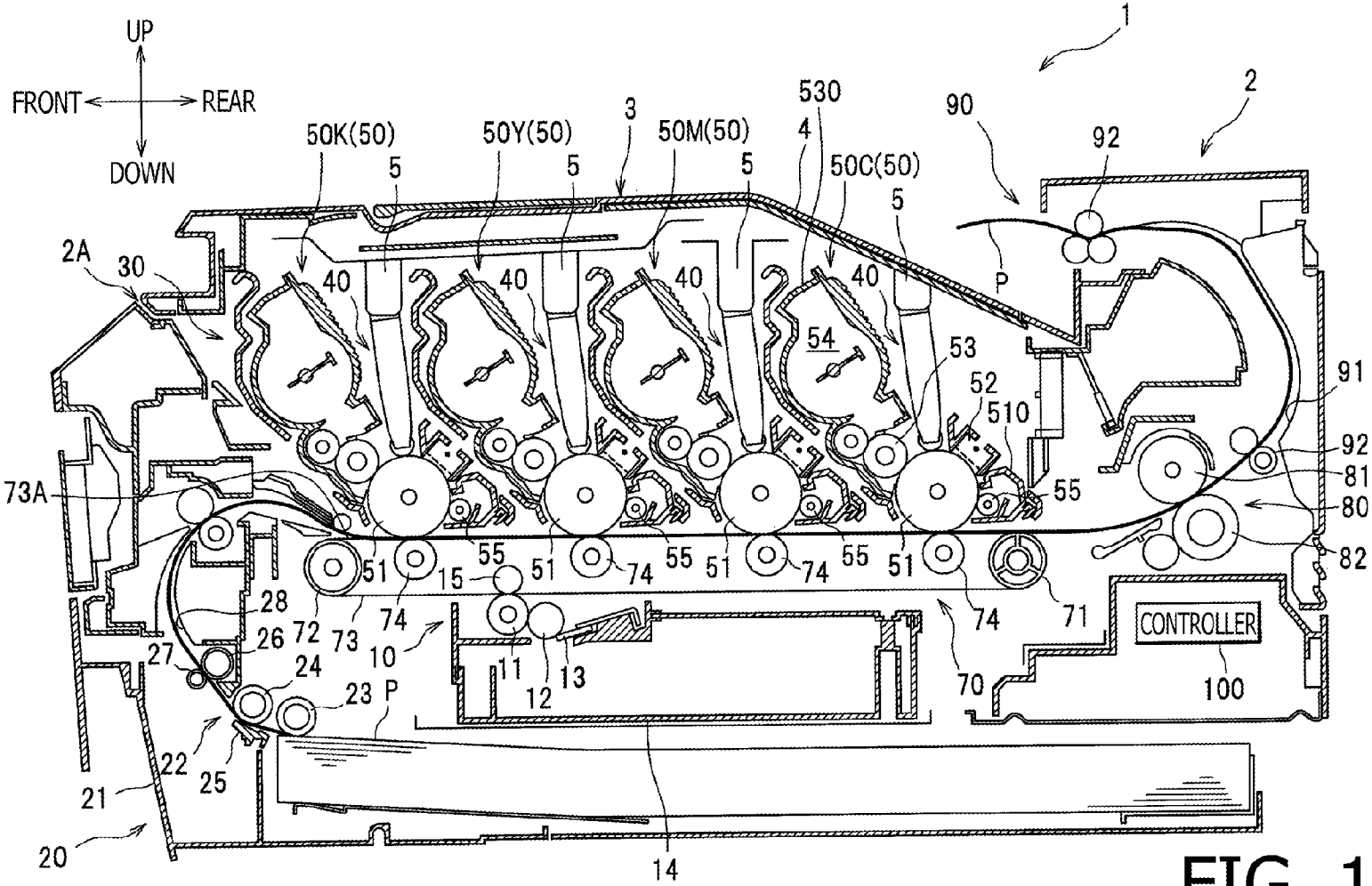

As shown in FIG. 1, a color printer 1 includes, in an apparatus main body 2, a sheet feeder 20 configured to feed a sheet P, an image forming unit 30 configured to form an image on the fed sheet P, a sheet ejector 90 configured to eject the sheet P with the image formed thereon, and a controller 100.

An opening 2A is formed at an upper portion of the apparatus main body 2. An upper cover 3, rotatably supported by the apparatus main body 2, is configured to open and close the opening 2A. The upper cover 3 has an upper face configured as a catch tray 4 to receive and support the sheet P ejected from the apparatus main body 2, and a lower face on which a plurality of LED attachment members 5 are disposed to hold LED units 40.

The sheet feeder 20 is disposed at a lower portion of the apparatus main body 2. The sheet feeder 20 includes a feed tray 21 detachably attached to the apparatus main body 2, and a sheet feeding mechanism 22 configured to feed the sheet P from the feed tray 21 to the image forming unit 30. The sheet feeding mechanism 22 is disposed at a front portion of the feed tray 21. The sheet feeding mechanism 22 includes a separation roller 24 and a separation pad 25.

In the sheet feeder 20, each sheet P placed in the feed tray 21 is fed upward in a manner separated on a sheet-by-sheet basis. Then, paper powder of the sheet is removed while the sheet is passing between a paper-powder removing roller 26 and a pinch roller 27. Thereafter, the sheet is turned around while passing through a conveyance path 28, and is conveyed rearward to the image forming unit 30.

The image forming unit 30 includes four LED units 40, four process cartridges 50, a transfer units 70, a cleaning unit 10, and a fuser unit 80.

Each LED unit 40 is swingably attached to a corresponding one of the LED attachment members 5, and is supported to be properly positioned by a positioning member provided at the apparatus main body 2.

The process cartridges 50 are arranged side by side along a front-to-rear direction, between the upper cover 3 and the sheet feeder 20. Each process cartridge 50 includes a photoconductive drum 51, a charger 52, a development roller 53, a toner container 54 for storing toner, and a cleaning roller 55.

The process cartridges 50 are arranged in an order of a process cartridge 50K for black, a process cartridge 50Y for yellow, a process cartridge 50M for magenta, and a process cartridge 50C for cyan from an upstream side in sheet conveyance direction (a moving direction of an upside-running portion of a conveyance belt 73). It is noted that, in the following descriptions and relevant drawings, an element (such as a photoconductive drum 51, a development roller 53, and a cleaning roller 55) for a particular color will be indicated with a specific letter ("K," "Y," "M," or "C") corresponding to the particular color (black, yellow, magenta, or cyan) being added to a reference number of the element.

The photoconductive drums 51 are provided in the plurality of process cartridges 50, respectively. When the plurality of process cartridges 50 are arranged side by side along the front-to-rear direction as described above, the photoconductive drums 51 are arranged in tandem along the front-to-rear direction.

Each development roller 53 is configured to carry toner thereon, and supply the toner to an electrostatic latent image on the corresponding photoconductive drum 51 while contacting the photoconductive drum 51.

Figure 2:
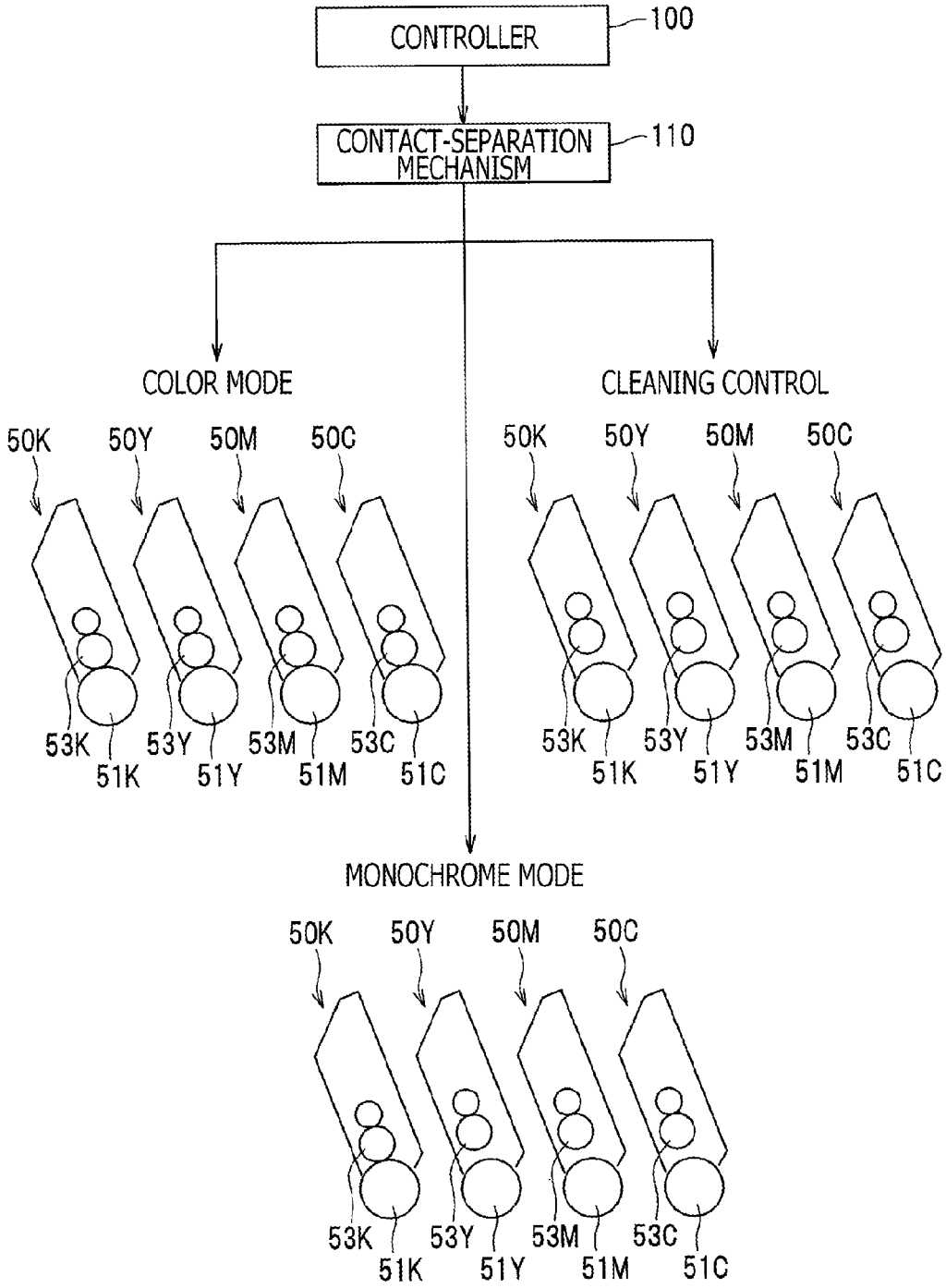

As shown in FIG. 2, each development roller 53 is caused to come into contact with and separate from the corresponding photoconductive drum 51 via a known contact-separation mechanism 110 controlled by the controller 100. Specifically, in a color mode, all the development rollers 53K, 53Y, 53M, and 53C come into contact with the photoconductive drums 51K, 51Y, 51M, and 51C so as to supply toner to the photoconductive drums 51K, 51Y, 51M, and 51C, respectively. Further, in a monochrome mode, the development roller 53K for black comes in contact with the photoconductive drum 51K, and the development rollers 53Y, 53M, and 53C for the other three colors are separate (spaced apart) from the respective photoconductive drums 51Y, 51M, and 51C. Further, in a cleaning control mode, all the development rollers 53K, 53Y, 53M, and 53C are separate from the photoconductive drums 51K, 51Y, 51M, and 51C.

As the contact-separation mechanism 110, such a mechanism may be employed that a member, which has a plurality of cam surfaces configured to press the development rollers 53K, 53Y, 53M, and 53C, is moved back and forth with a rack-pinion mechanism and a driving source (such as a motor) rotatable backward and forward. In the contact-separation mechanism 110, each development roller 53 comes into contact with the corresponding photoconductive drum 51 when none of the development rollers 53 is pressed by the cam surfaces in the color mode. Further, in the monochrome mode, the member having the plurality of cam surfaces is moved from a position for the color mode to a position for monochrome mode, so as to press the development rollers 53Y, 53M, and 53C for color printing by three cam surfaces for color printing. Thereby, the development rollers 53Y, 53M, and 53C for color printing are separated from the photoconductive drums 51Y, 51M, and 51C for color printing, and the development roller 53K for monochrome printing comes into contact with the photoconductive drum 51K for monochrome printing.

Further, in the cleaning control mode, the member having the plurality of cam surfaces is moved from the position for monochrome mode to a position for the cleaning control mode, so as to press all the development rollers 53 by all the cam surfaces. Thereby, all the development rollers 53 are separated from the photoconductive drums 51, respectively.

Each development roller 53 is configured to not rotate when being separate from the corresponding photoconductive drum 51. Specifically, when a below-mentioned drive switching mechanism 200 is controlled by the controller 100, each development roller 53 is put into a rotational state corresponding to an intended operational mode of the color mode, the monochrome mode, and the cleaning control mode.

As shown in FIG. 1, a corresponding one of the cleaning rollers 55 is disposed adjacent to each photoconductive drum 51. Each cleaning roller 55 is configured to be supplied with a cleaning bias. Thereby, each cleaning roller 55 is allowed to temporarily hold at least a part of toner adhering onto the corresponding photoconductive drum 51.

The transfer unit 70 is disposed between the sheet feeder 20 and the process cartridges 50. The transfer unit 70 includes a driving roller 71, a driven roller 72, a conveyance belt 73, and transfer rollers 74.

The driving roller 71 and the driven roller 72 are disposed separate from each other in the front-to-rear direction and parallel to each other along a left-to-right direction. An endless conveyance belt 73 is wound around the driving roller 71 and the driven roller 72. The conveyance belt 73 has a belt surface 73A configured to face and contact each photoconductive drum 51. The conveyance belt 73 is turned by the driving roller 71 such that the belt surface 73A moves along the direction along which the photoconductive drums 51 are arranged. Further, inside a space surrounded by the conveyance belt 73, four transfer rollers 74 are disposed to face the four photoconductive drums 51, respectively. Each transfer roller 74 is configured to pinch the conveyance belt 73 with the corresponding photoconductive drum 51. Each transfer roller 74 is further configured to be supplied with a transfer bias by constant current control in an operation of transferring a toner image.

The cleaning unit 10 is configured to retrieve (collect) toner adhering onto the conveyance belt 73 while relatively sliding in contact with the conveyance belt 73. The cleaning unit 10 is disposed below the conveyance belt 73. Specifically, the cleaning unit 10 includes a sliding contact roller 11, a retrieving roller 12, a blade 13, and a waste toner container 14.

The sliding contact roller 11 is disposed to contact an outer circumferential surface of the conveyance belt 73. The sliding contact roller 11 is configured to collect substances adhering onto the conveyance belt 73 when a retrieving bias is applied between the sliding contact roller 11 and a backup roller 15 disposed to face an inner circumferential surface of the conveyance belt 73.

The retrieving roller 12 is configured to retrieve substances adhering onto the sliding contact roller 11 while relatively sliding in contact with the sliding contact roller 11. The blade 13 is disposed to relatively slide in contact with the retrieving roller 12. The blade 13 is configured to scrape off the substances adhering onto the retrieving roller 12. The waste toner container 14 is configured to receive and store the substances scraped off by the blade 13.

The fuser unit 80 is disposed behind the process cartridges 50 and the transfer unit 70. The fuser unit 80 includes a heating roller 81, and a pressing roller 82 that is disposed to face the heating roller 81 and configured to press the heating roller 81.

In the image forming unit 30 configured as above, a surface of the photoconductive drum 51 is evenly and positively charged by the charger 52, and thereafter exposed by the corresponding LED unit 40. Thereby, an electrical potential of the exposed portion is lowered, and an electrostatic latent image based on image data is formed on the photoconductive drum 51. Afterward, the electrostatic latent image is supplied with positively charged toner from the development roller 53, and thereby, a toner image is carried on the photoconductive drum 51.

When a sheet P fed onto the conveyance belt 73 passes between the photoconductive drum 51 and the transfer roller 74 disposed inside the space surrounded by the conveyance belt 73, the toner image formed on the photoconductive drum 51 is transferred onto the sheet P. Then, when the sheet P passes between the heating roller 81 and the pressing roller 82, the toner image transferred onto the sheet P is thermally fixed.

The sheet ejector 90 includes an ejector-side conveyance path 91 and feed rollers 92. The ejector-side conveyance path 91 is formed to extend upward from an exit of the fuser unit 80 and turn around forward. The feed rollers 92 are configured to feed the sheet P toward the catch tray 4. The sheet P with the toner image transferred and thermally fixed thereon is conveyed along the ejector-side conveyance path 91, ejected out of the apparatus main body 2, and put onto the catch tray 4.

<Drive Switching Mechanism and Controller>

Figure 3:
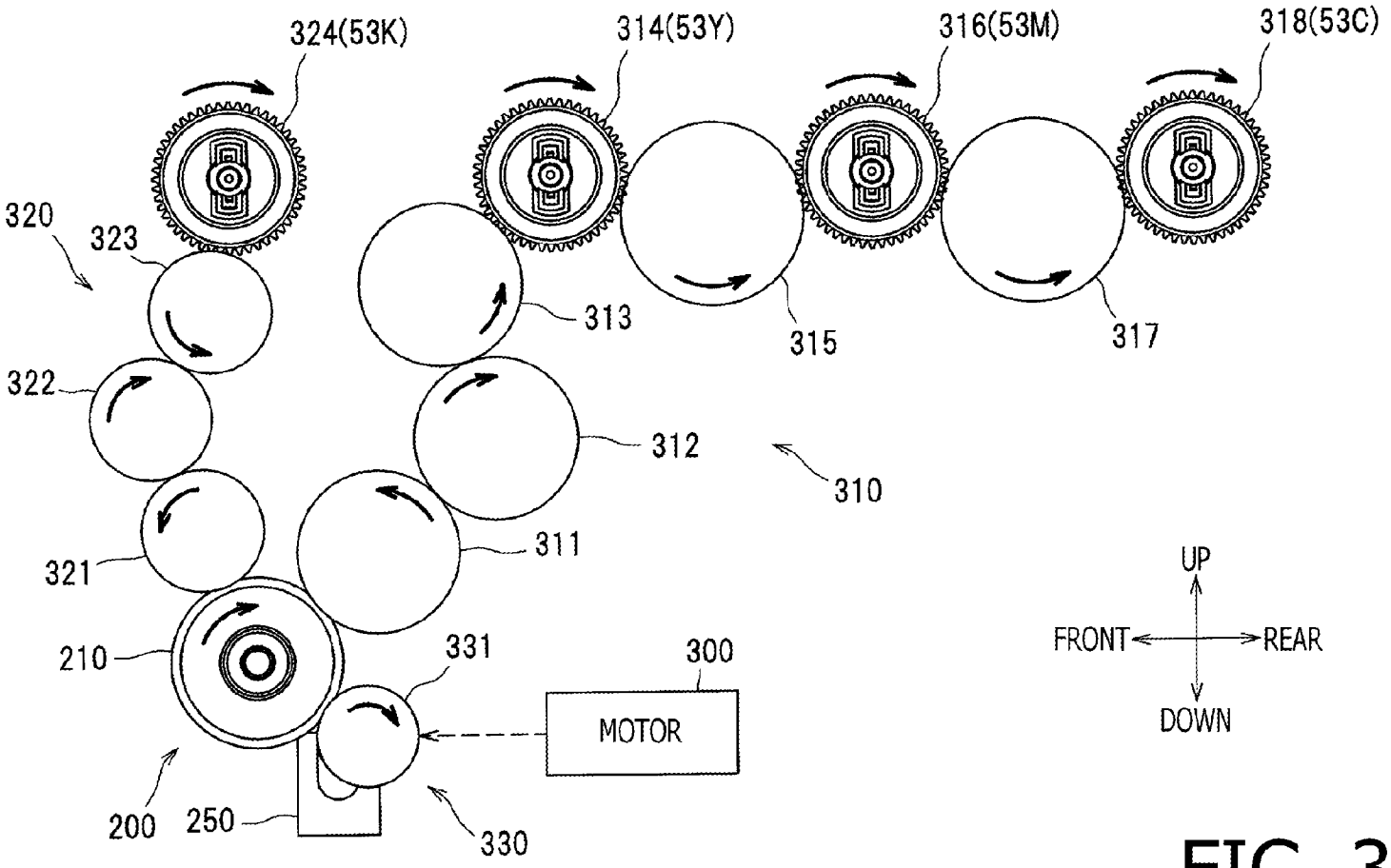

Hereinafter, the drive switching mechanism 200 and the controller will be described in detail. As shown in FIG. 3, the drive switching mechanism 200 is configured to switch a transmission mode to transmit a driving force from a motor 300 to the development rollers 53, depending on the operational mode such as the color mode, the monochrome mode, and the cleaning control mode. The drive switching mechanism 200 is disposed between the motor 300 and the development rollers 53Y, 53M, and 53C for color printing, and between the motor 300 and the development roller 53K for monochrome printing. Specifically, the drive switching mechanism 200 is disposed between a color-side transmission mechanism 310 and a motor-side drive mechanism 330 and between a monochrome-side transmission mechanism 320 and the motor-side drive mechanism 330. In the embodiment, the motor 300 is used in common for driving the development rollers 53 and driving the photoconductive drums 51.

The color-side transmission mechanism 310 is configured to transmit the driving force from the motor 300 to the development rollers 53Y, 53M, and 53C for color printing. The color-side transmission mechanism 310 includes a plurality of for-color gears 311 to 318. Three for-color gears 314, 316, and 318 of the plurality of for-color gears 311 to 318 are fixed to main-body-side couplings for transmitting the driving force to the three development rollers 53Y, 53M, and 53C for color printing. Thus, as the main-body-side couplings engage with cartridge-side couplings, the development rollers 53Y, 53M, and 53C are rotated. It is noted that, in FIG. 3, pitch circles indicate all gears except for the for-color gears 314, 316, and 318 fixed to axis end portions of the development rollers 53Y, 53M, and 53C for color printing, a below-mentioned for-monochrome gear 324 fixed to an axis end portion of the development roller 53K for monochrome printing, and a below-mentioned switching gear 210.

The drive switching mechanism 200 is coupled with the for-color gear 314 corresponding to the development roller 53Y for yellow via the three gears 311 to 313. In addition, the for-color gear 314 corresponding to the development roller 53Y for yellow is coupled with the for-color gear 316 corresponding to the development roller 53M for magenta via the single for-color gear 315. Further, the for-color gear 316 corresponding to the development roller 53M for magenta is coupled with the for-color gear 318 corresponding to the development roller 53C for cyan via the single for-color gear 317.

Thus, owing to the color-side transmission mechanism 310 configured as above, when the driving force is transmitted from the drive switching mechanism 200 to the most upstream for-color gear 311 in a transmission direction of the driving force, all the for-color gears 311 to 318 are rotated, and thereby the three development rollers 53Y, 53M, and 53C for color printing are rotated. It is noted that the most upstream for-color gear 311 is disposed, in a radial direction thereof, adjacent to a below-mentioned switching gear 210 of the drive switching mechanism 200.

The monochrome-side transmission mechanism 320 is configured to transmit the driving force from the motor 300 to the development roller 53K for monochrome printing. The monochrome-side transmission mechanism 320 includes a plurality of for-monochrome gears 321 to 324. Of the plurality of for-monochrome gears 321 to 324, the most downstream for-monochrome gear 324 in the transmission direction of the driving force is fixed to the main-body-side coupling for transmitting the driving force to the development roller 53K for monochrome printing. Then, as the main-body-side coupling for transmitting the driving force to the development roller 53K engages with the cartridge-side coupling, the development roller 53K is rotated.

The drive switching mechanism 200 is coupled with the for-monochrome gear 324 corresponding to the development roller 53K for monochrome printing via the three for monochrome gears 321 to 323. Thus, owing to the monochrome-side transmission mechanism 320 configured as above, the driving force is transmitted from the drive switching mechanism 200 to the most upstream for monochrome gear 321 in the transmission direction of the driving force. Thereby, all the for-monochrome gears 321 to 324 are rotated, and the development roller 53K for monochrome printing is rotated. It is noted that the most upstream for-monochrome gear 321 is disposed, in a radial direction thereof, adjacent to the below-mentioned switching gear 210 of the drive switching mechanism 200.

The motor-side drive mechanism 330 is configured to transmit the driving force from the motor 300 to the drive switching mechanism 200. The motor-side drive mechanism 330 includes a motor-side gear 331 and a plurality of gears (not shown). The motor-side gear 331 is disposed, in a radial direction thereof, adjacent to the below-mentioned switching gear 210 of the drive switching mechanism 200. Further, the motor-side gear 331 is coupled with the motor 300 via a plurality of gears (not shown). Thus, owing to the motor-side drive mechanism 330 configured as above, when the motor 300 is driven to rotate, the driving force from the motor 300 is transmitted to the drive switching mechanism 200 via the motor-side drive mechanism 330.

Figure 4:
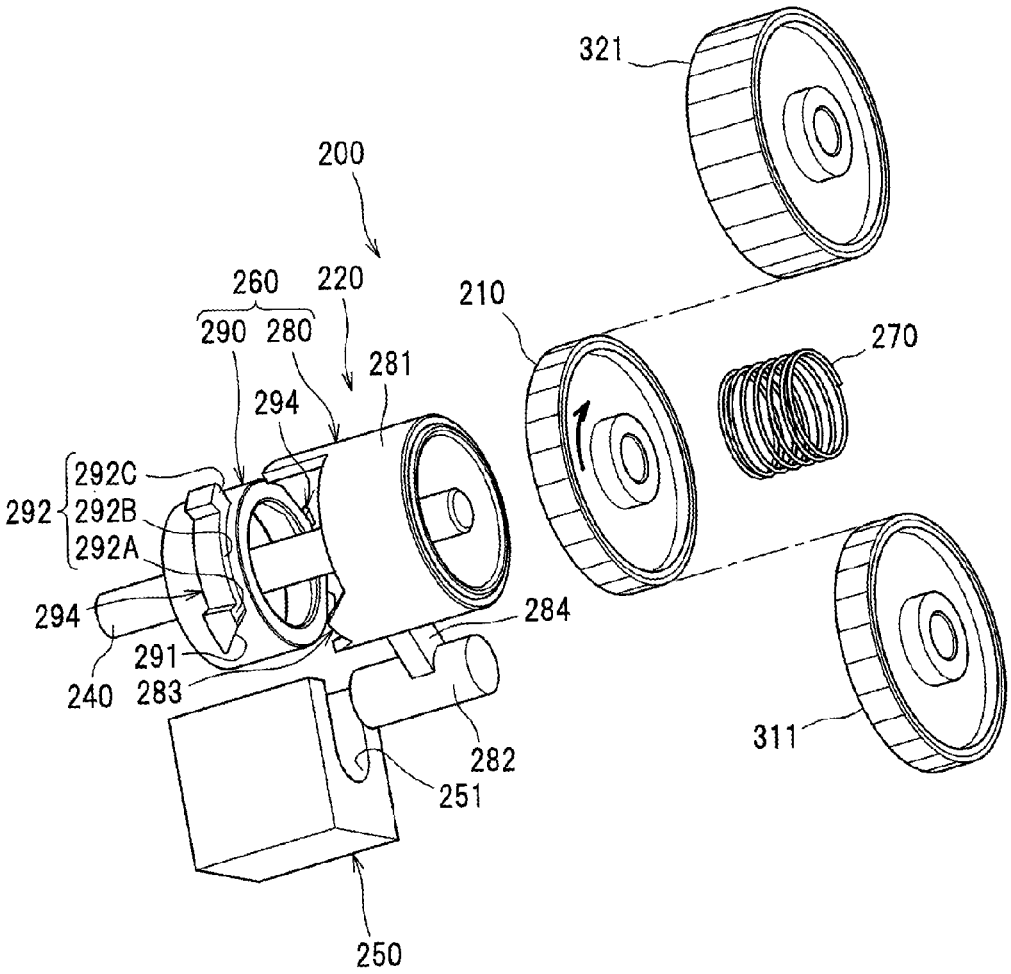
FIG. 4 is an exploded perspective view of a drive switching mechanism from a side of a compression coil spring in the embodiment according to one or more aspects of the present invention.
Figure 5:
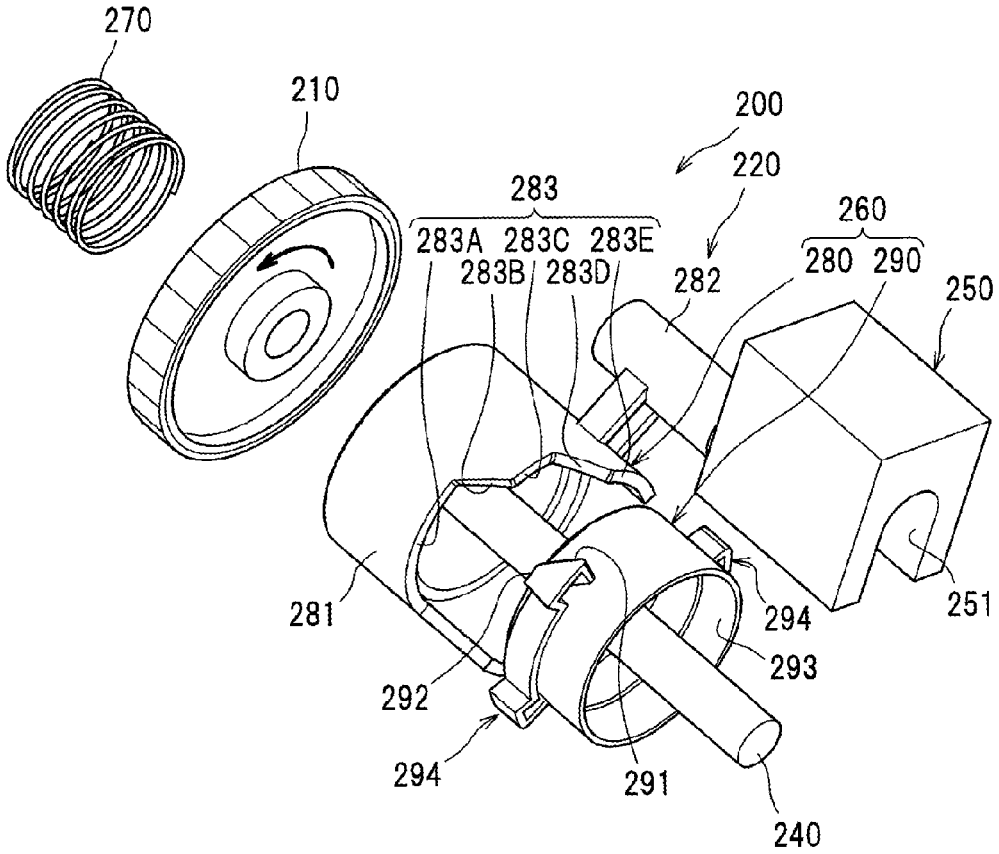
FIG. 5 is an exploded perspective view of the drive switching mechanism from a side of a pressing member in the embodiment according to one or more aspects of the present invention.

As shown in FIGS. 4 and 5, the drive switching mechanism 200 includes the switching gear 210 configured to receive the driving force from the motor 300, and a moving mechanism 220 configured to move the switching gear 210 in a rotational axis direction of the switching gear 210 (i.e., in a rotational axis direction of the development rollers 53). The switching gear 210 is supported by a supporting shaft 240 of the moving mechanism 220 so as to be rotatable around the supporting shaft 240 and movable in the rotational axis direction of the switching gear 210. Thereby, the switching gear 210 is configured to move between an all-separated position shown in FIG. 6A and a color position shown in FIG. 8A via a monochrome position shown in FIG. 7A.

The motor-side gear 331 is formed to be substantially three times as wide as the switching gear 210. The for-monochrome gear 321 is formed to be substantially double as wide as the switching gear 210. The for-color gear 311 is formed to be substantially as wide as the switching gear 210. Further, the motor-side gear 331, the for-monochrome gear 321, and the for-color gear 311 are disposed such that their end faces on a first side (i.e., the right side in FIGS. 6A, 7A, and 8A) in their rotational axis direction are positionally coincident with each other in the rotational axis direction.

When located in the all-separated position shown in FIG. 6A (more specifically, located at a second-side end (i.e., at an end of a second side opposite to the first side) of the motor-side gear 331 in the rotational axis direction), the switching gear 210 disengages from (separates out of) the for-color gear 311 and the for-monochrome gear 321 in the rotational axis direction, and engages with the motor-side gear 331. Thereby, as shown in FIG. 6C, when the switching gear 210 is in the all-separated position, neither the for-color gear 311 nor the for-monochrome gear 321 is rotated so as to restrict the driving force from the motor 300 from being transmitted to the color-side transmission mechanism 310 or the monochrome-side transmission mechanism 320. It is noted that, in FIGS. 6C, 7C, and 8C, each gear to which the driving force is transmitted is indicated by a heavy (thick) line for emphasis, and each gear to which the driving force is not transmitted is indicated by a thin line.

Further, when located in the monochrome position shown in FIG. 7A (more specifically, located at a middle portion in the rotational axis direction of the motor-side gear 331), the switching gear 210 engages with the motor-side gear 331 and the for-monochrome gear 321, and disengages from (separates out of) the for-color gear 311 in the rotational axis direction. Thereby, as shown in FIG. 7C, when the switching gear 210 is in the monochrome position, the for-color gear 311 is not rotated so as to restrict the driving force from the motor 300 from being transmitted to the color-side transmission mechanism 310.

Further, as located in the color position shown in FIG. 8A (more specifically, located at a first-side end in the rotational axis direction of the motor-side gear 331), the switching gear 210 engages with the motor-side gear 331, the for-monochrome gear 321, and the for-color gear 311. Thereby, as shown in FIG. 8C, when the switching gear 210 is in the color position, the for-color gear 311 and the for-monochrome gear 321 are rotated together with the switching gear 210, so as to allow the driving force from the motor 300 to be transmitted to the color-side transmission mechanism 310 and the monochrome-side transmission mechanism 320.

As shown in FIGS. 4 and 5, the moving mechanism 220 includes the supporting shaft 240, a back-and-forth movable member 250, a cam mechanism 260, and a compression coil spring 270.

The supporting shaft 240 is fixed to the apparatus main body 2. In addition, to a suitable location of the supporting shaft 240, a below-mentioned pressing member 290 is fixed. Further, the supporting shaft 240 is configured to support the switching gear 210 and a below-mentioned cam member 280 of the cam mechanism 260 movably along the rotational axis direction, on the first side in the rotational axis direction relative to the pressing member 290.

The back-and-forth movable member 250 is supported to be movable along the front-to-rear direction (see FIG. 3) that is substantially perpendicular to a rotational axis direction of the development rollers 53. Specifically, the back-and-forth movable member 250 is supported by a guide member (not shown) provided to the apparatus main body 2, so as to be slidable relative to the guide member along the front-to-rear direction. In the embodiment, the back-and-forth movable member 250 is configured to move back and forth with a rack-pinion mechanism and a driving source (such as a motor) rotatable backward and forward. Further, the driving source is used in common for driving the aforementioned contact-separation mechanism 110 (as well as for driving the back-and-forth movable member 250).

The back-and-forth movable member 250 is placed in a position shown in FIG. 6B when the contact-separation mechanism 110 is in a state for the cleaning control mode. The back-and-forth movable member 250 is placed in a position shown in FIG. 7B when the contact-separation mechanism 110 is in a state for the monochrome mode. The back-and-forth movable member 250 is placed in a position shown in FIG. 8B when the contact-separation mechanism 110 is in a state for the color mode. Further, the back-and-forth movable member 250 includes a supporting groove 251 formed to support an operating portion 282 of the below-mentioned cam member 280 slidably in a vertical direction.

As shown in FIG. 4, the cam mechanism 260 is configured to press the switching gear 210 toward the first side in the rotational axis direction of the switching gear 210 by converting a direction of a pressing force received from the back-and-forth movable member 250 into the rotational axis direction. The cam mechanism 260 includes the cam member 280 and the pressing member 290.

The cam member 280 is configured to rotate in response to being pressed by the back-and-forth movable member 250. The cam member 280 includes a main body portion 281, the operating portion 282, and two cam-shaped portions 283. The operating portion 282 is disposed in a position radially separate from a rotational axis of the main body portion 281, and is configured to be pressed by the back-and-forth movable member 250. The cam-shaped portions 283 are disposed in a position radially separate from the rotational axis of the main body portion 281, on a side of the main body portion 281 opposite to the switching gear 210 in the rotational axis direction.

The main body portion 281 is formed substantially in a cylindrical shape. The main body portion 281 includes a shaft-supported portion (not shown) that is formed to radially protrude inward from an inner circumferential surface of the main body portion 281, and is rotatably supported by the supporting shaft 240.

The operating portion 282 is formed in a columnar shape extending in the rotational axis direction. Further, the operating portion 282 is disposed at a distal end of an arm 284 and formed integrally with the arm 284. The arm 284 is formed to radially protrude outward from an outer circumferential surface of the main body portion 281.

As shown in FIG. 5, each cam-shaped portion 283 is formed in a stepped shape to have a first flat surface 283A, a first slanted surface 283B, a second flat surface 283C, a second slanted surface 283D, and a third flat surface 283E in the above order in a direction from the switching gear 210 to the pressing member 290. The first slanted surface 283B and the second slanted surface 283D are slanted with respect to the rotational axis direction and a rotational direction of the cam member 280. Each of the first flat surface 283A, the second flat surface 283C, and the third flat surface 283E is formed to extend from a corresponding one of the slanted surfaces 283B and 283D along a direction perpendicular to the rotational axis direction, that is, along the rotational direction.

The first slanted surfaces 283B and the second slanted surfaces 283D are configured to engage with below-mentioned pressing surfaces 291 of the pressing member 290 in the rotational direction of the cam member 280. Specifically, each of the slanted surfaces 283B and 283D is formed to face toward a downstream side in a rotational direction (indicated by an arrow in FIG. 5) of the switching gear 210 configured to be rotated by the driving force. More specifically, each of the slanted surfaces 283B and 283D is slanted in a direction toward the downstream side in the rotational direction of the switching gear 210 and toward the switching gear 210 from the pressing member 290, with respect to the rotational axis direction and the rotational direction of the cam member 280.

The first flat surface 283A, the second flat surface 283C, and the third flat surface 283E are formed to be perpendicular to the rotational axis direction. Thereby, each of the flat surfaces 283A, 283C, and 283E is configured to contact a below-mentioned supporting surface 292 of the pressing member 290 in the rotational axis direction. Specifically, in the rotational direction of the cam member 280, lengths of the second flat surface 283C and the third flat surface 283E are longer than a length of a first supporting surface 292A (see FIG. 4) of the below-mentioned supporting surface 292. Further, in the rotational direction of the cam member 280, a length of the first flat surface 283A is longer than the lengths of the second flat surface 283C and the third flat surface 283E.

The two cam-shaped portions 283 configured as above are disposed on two sides across the supporting shaft 240 in a radial direction of the cam member 280, respectively. In other words, one cam-shaped portion 283 is disposed on each of the two sides across the supporting shaft 240 in the radial direction of the cam member 280.

The pressing member 290 is configured to press the cam member 280 toward the switching gear 210 by engaging with the cam-shaped portion 283 of the cam member 280 which is rotating. The pressing member 290 includes a pressing main body portion 293 fixed to the supporting shaft 240, and two pressing portions 294. The two pressing portions 294 are formed integrally with an outer circumferential surface of the pressing main body portion 293, so as to correspond to the two cam-shaped portions 283, respectively.

The pressing main body portion 293 is formed substantially in a cylindrical shape. The pressing main body portion 293 includes a protrusion (not shown) that is formed to radially protrude inward from an inner circumferential surface of the pressing main body portion 293 and is fixed to the supporting shaft 240.

The pressing portions 294 are formed to radially protrude outward from the outer circumferential surface of the pressing main body 293, with one pressing portion 294 provided for each cam-shaped portion 283. Each pressing portion 294 includes a pressing surface 291 and a supporting surface 292. The pressing surface 291 is formed as a slanted surface substantially parallel to the slanted surfaces 283B and 283D of the cam-shaped portion 283. The supporting surface 292 is formed as a flat surface substantially parallel to the flat surfaces 283A, 283C, and 283E of the cam-shaped portion 283. As shown in FIG. 4, the supporting surface 292 includes a first supporting surface 292A, a second supporting surface 292B, and a third supporting surface 292C. The first supporting surface 292A is formed to be adjacent to the pressing surface 291 on a downstream side relative to the pressing surface 291 in the rotational direction of the switching gear 210. The second supporting surface 292B is formed to be adjacent to the first supporting surface 292A on a downstream side relative to the first supporting surface 292A in the rotational direction of the switching gear 210. The third supporting surface 292C is formed to be adjacent to the second supporting surface 292B on a downstream side relative to the second supporting surface 292B in the rotational direction of the switching gear 210. The first supporting surface 292A is substantially as wide as the third supporting surface 292C in the radial direction of the pressing member 290. The second supporting surface 292B is narrower than the first supporting surface 292A and the third supporting surface 292C in the radial direction of the pressing member 290.

The compression coil spring 270 is disposed on a side of the switching gear 210 opposite to the cam mechanism 260 in the rotational axis direction. The compression coil spring 270 is configured to urge the switching gear 210 toward the cam mechanism 260. Specifically, the compression coil spring 270 is configured such that one end thereof is fixed to the apparatus main body 2, and the other end thereof contacts an end face of the switching gear 210.

In the moving mechanism 220 configured as above, when the back-and-forth movable member 250 is in the position shown in FIG. 6B (i.e., when the switching gear 210 is in the all-separated position shown in FIG. 6A), the first flat surfaces 283A of the cam member 280 are supported by the supporting surfaces 292 of the pressing portions 294.

When the back-and forth movable member 250 is moved from the position shown in FIG. 6B to the position shown in FIG. 7B, the cam member 280 rotates in the direction indicated by the arrow (e.g., see FIG. 7A), and the first slanted surfaces 283B of the cam member 280 engage with the pressing surfaces 291 of the pressing portions 294. Then, when the cam member 280 further rotates, as shown in FIG. 7A, the cam member 280 and the switching gear 210 are pressed, by the pressing surfaces 291, rightward in FIG. 7A against the urging force of the compression coil spring 270. Thereby, the switching gear 210 is moved from the all-separated position to the monochrome position. It is noted that, in the monochrome position, the second flat surfaces 283C of the cam member 280 are supported by the supporting surfaces 292 of the pressing portions 294.

When the back-and-forth movable member 250 is moved from the position shown in FIG. 7B to the position shown in FIG. 8B, the cam member 280 rotates in the direction indicated by the arrow (e.g., see FIG. 8A), and the second slanted surfaces 283D of the cam member 280 engage with the pressing surfaces 291 of the pressing portions 294. Then, when the cam member 280 further rotates, as shown in FIG. 8A, the cam member 280 and the switching gear 210 are pressed, by the pressing surfaces 291, rightward in FIG. 8A against the urging force of the compression coil spring 270. Thereby, the switching gear 210 is moved from the monochrome position to the color position. It is noted that, in the color position, the third flat surfaces 283E of the cam member 280 are supported by the supporting surfaces 292 of the pressing portions 294.

In order to move the switching gear 210 from the color position to the monochrome position, or to move the switching gear 210 from the monochrome position to the all-separated position, the back-and-forth movable member 250 is moved in a direction opposite to the aforementioned direction. Thereby, when the slanted surfaces 283B and 283D come to the pressing surfaces 291, the cam member 280 and the switching gear 210 are moved leftward in FIGS. 6A, 7A, and 8A by the urging force of the compression coil spring 270, and are placed in their respective positions.

Further, as schematically shown in FIG. 6A, the switching gear 210 includes guide surfaces 211 formed at corner portions of gear teeth of the switching gear 210. Additionally, the for-monochrome gear 321 includes guide surfaces 321A formed at corner portions of gear teeth of the for-monochrome gear 321. Further, the for-color gear 311 includes guide surfaces 311A formed at corner portions of gear teeth of the for-color gear 311. The guide surfaces 211, 321A, and 311A are configured to guide the gear teeth of the switching gear 210 to be engaged between the gear teeth of the for-monochrome gear 321 or between the gear teeth of the for-color gear 311. Thereby, it is possible to smoothly establish the engagement between the switching gear 210 and the for-monochrome gear 321 and the engagement between the switching gear 210 and the for-color gear 311.

The controller 100 shown in FIG. 1 includes a CPU, a ROM, and a RAM. The controller 100 is configured to control the sheet feeder 20, the image forming unit 30, the sheet ejector 90, the contact-separation mechanism 110, and the drive switching mechanism 200, in accordance with processor-executable programs previously prepared (e.g., previously stored in a non-volatile memory such as the ROM). Specifically, when performing known cleaning control, the controller 100 controls the motor 300 to rotate in one rotational direction in a state where each development roller 53 is separated from the corresponding photoconductive drum 51, and the switching gear 210 of the drive switching mechanism 200 is located in the all-separated position shown in FIG. 6A. Thereby, each development roller 53 is restricted from rotating, and each photoconductive drum 51 is caused to rotate. Further, toner held on the cleaning rollers 55 is retrieved by the cleaning unit 10, via the photoconductive drums 51 and the transfer unit 70. Thus, any development roller 53 is not wastefully rotated in the cleaning control mode. Therefore, it is possible to prevent deterioration of toner held on the development rollers 53 in the cleaning control mode.

Further, when switching from the cleaning control mode to the monochrome mode, the controller 100 controls the driving source for the contact-separation mechanism 110 and the back-and-forth movable member 250 to rotate in one direction by a predetermined rotational amount. Thereby, only the development roller 53K for monochrome printing is controlled to come into contact with the photoconductive drum 51K, and the switching gear 210 is moved from the all-separated position shown in FIG. 6A to the monochrome position shown in FIG. 7A. Furthermore, the controller 100 controls the motor 300 to rotate in the one rotational direction, so as to rotate the development roller 53K and each photoconductive drum 51. Thereby, it is possible to perform monochrome printing with the development roller 53K for monochrome.

Further, when switching from the monochrome mode to the color mode, the controller 100 controls the driving source for the contact-separation mechanism 110 and the back-and-forth movable member 250 to rotate in the one direction by a predetermined rotational amount. Thereby, each development roller 53 is controlled to contact the corresponding photoconductive drum 51, and the switching gear 210 is moved from the monochrome position shown in FIG. 7A to the color position shown in FIG. 8A. Furthermore, the controller 100 controls the motor 300 to rotate in the one rotational direction, so as to rotate each development roller 53 and each photoconductive drum 51. Thereby, it is possible to perform color printing with every development roller 53.

Further, when switching from the color mode to the monochrome mode, or from the monochrome mode to the cleaning control mode, the controller 100 controls the driving source for the contact-separation mechanism 110 and the back-and-forth movable member 250 to rotate in the other direction by a predetermined rotational amount. Thereby, the controller 100 changes the contact/separate state of each development roller 53 and the position of the switching gear 210. Furthermore, the controller 100 controls the motor 300 to rotate in the one rotational direction, so as to perform the monochrome mode or the cleaning control mode.

According to the embodiment as described above, the following advantageous effects are provided. The color printer 1 is configured to switch one operational mode to another by moving the switching gear 210 to an intended position in the rotational axis direction as needed. Therefore, the color printer 1 is not required to switch the rotational direction of the motor 300. Thus, it is possible to use the motor 300 in common for driving the development rollers 53 and the photoconductive drums 51.

Each cam-shaped portion 283 includes the flat surfaces 283A, 283C, and 283E perpendicular to the rotational axis direction. Therefore, the pressing portions 294 are allowed to receive the urging force from the compression coil spring 270 by the supporting surfaces 292 of the pressing portions 294 that are formed to be substantially parallel to the flat surfaces 283A, 283C, and 283E. Thus, it is possible to prevent the switching gear 210 or the cam member 280 from being wrongly moved by the urging force of the compression coil spring 270, in a more effective manner, e.g., than when the cam-shaped portions 283 do not include any flat surface but slanted surfaces.

The slanted surfaces 283B and 283D of each cam-shaped portion 283 face toward the downstream side in the rotational direction of the switching gear 210 configured to rotate by the driving force. Suppose, for instance, that the cam member 280, which is adjacent to the switching gear 210, is rotated by a frictional force generated between the cam member 280 and the switching gear 210 in response to the switching gear 210 placed in the monochrome position shown in FIG. 7A being rotated by the driving force. In this case, the second slanted surfaces 283D engage with the pressing surfaces 291 of the pressing portions 294. Thereby, it is possible to stop the rotation of the cam member 280 and maintain the position of the switching gear 210.

Suppose, for comparison, that if the slanted surfaces 283B and 283D face toward the upstream side in the rotational direction of the switching gear 210, the cam member 280 is rotated by the frictional force generated between the cam member 280 and the switching gear 210 in the aforementioned manner, in a state where the supporting surfaces 292 of the pressing portions 294 support the second flat surfaces 283C of the cam member 280. In this case, the second slanted surfaces 283D, which are ascending slopes for the second flat surfaces 283C, move farther away from the pressing surfaces 291. Further, the first slanted surfaces 283B, which are descending slopes for the second flat surfaces 283C, move closer to the pressing surfaces 291. Then, when the first slanted surfaces 283B, which are descending slopes for the second flat surfaces 283C, reach the pressing surfaces 291, the switching gear 210 and the cam member 280 might wrongly be moved by the urging force of the compression coil spring 270. On the contrary, in the embodiment, the slanted surfaces 283B and 283D face toward the downstream side in the rotational direction of the switching gear 210. Therefore, even when the cam member 280 is rotated by the frictional force generated between the cam member 280 and the switching gear 210 in the aforementioned manner, the slanted surfaces 283D, which are ascending slopes for the second flat surfaces 283C, move closer to the pressing surfaces 291 and come into contact with the pressing surfaces 291. Thus, it is possible to stop the rotation of the cam member 280 and maintain the position of the switching gear 210.

In order to exert the aforementioned effects in a favorable manner, it is required to determine an angle between the second slanted surfaces 283D and the pressing surfaces 291 and a material of each relevant element in such a manner that engagement forces between the second slanted surfaces 283D (which are ascending slopes for the second flat surfaces 283C) and the pressing surfaces 291 exceed the frictional force between the switching gear 210 and the cam member 280.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

[Modifications]

In the aforementioned embodiment, each of the color-side transmission mechanism 310 and the monochrome-side transmission mechanism 320 includes a plurality of gears. Nonetheless, each of the color-side transmission mechanism 310 and the monochrome-side transmission mechanism 320 may include a belt and/or a pulley.

In the aforementioned embodiment, in the all-separated position, the switching gear 210 engages with the motor-side gear 331. However, for instance, in the all-separated position, the switching gear 210 may disengage from the motor-side gear 331 in the rotational axis direction.

In the aforementioned embodiment, exemplified is the moving mechanism 220 including the supporting shaft 240, the back-and-forth movable member 250, the cam mechanism 260, and the compression coil spring 270. However, the moving mechanism 220 may be configured in different manners. For instance, the moving mechanism 220 may include a cylinder configured to press the switching gear 210 in the rotational axis direction, and a spring configured to urge the switching gear 210 toward the cylinder.

In the aforementioned embodiment, the compression coil spring 270 is exemplified as an urging member. However, different urging members such as a leaf spring and a wire spring may be employed.

In the aforementioned embodiment, the switching gear 210 includes the guide surfaces 211 formed at the corner portions of the gear teeth of the switching gear 210. Additionally, the for-monochrome gear 321 includes the guide surfaces 321A formed at the corner portions of the gear teeth of the for-monochrome gear 321. Further, the for-color gear 311 includes the guide surfaces 311A formed at the corner portions of the gear teeth of the for-color gear 311. However, at least one of the switching gear 210 and the for-monochrome gear 321 may include guide surfaces formed at the corner portions of the gear teeth of the at least one of the switching gear 210 and the for-monochrome gear 321. Further, at least one of the switching gear 210 and the for-color gear 311 may include guide surfaces formed at the corner portions of the gear teeth of the at least one of the switching gear 210 and the for-color gear 311.

In the aforementioned embodiment, aspects of the present invention are applied to the color printer 1. Nonetheless, aspects of the present invention may be applied to different image forming apparatuses such as copy machines and multi-function peripherals.

What is claimed is:

1. An image forming apparatus comprising:

a first development roller configured to carry development agent of a first color;

a second development roller configured to carry development agent of a second color;

a driving source;

a first transmission mechanism configured to transmit a driving force from the driving source to the first development roller, the first transmission mechanism including a first gear having gear teeth;

a second transmission mechanism configured to transmit the driving force from the driving source to the second development roller, the second transmission mechanism including a second gear having gear teeth; and a drive switching mechanism disposed between the driving source and the first transmission mechanism and between the driving source and the second transmission mechanism, the drive switching mechanism comprising a switching gear having gear teeth and configured to move along a rotational axis direction of the first development roller, between:

a first position to transmit the driving force to the first transmission mechanism and the second transmission mechanism; and a second position to restrict the driving force from being transmitted from the driving source to the first transmission mechanism and allow the driving force to be transmitted from the driving source to the second transmission mechanism, wherein when the switching gear is in the first position, the gear teeth of the switching gear engage with the gear teeth of the first gear and the gear teeth of the second gear, wherein the drive switching mechanism comprises a moving mechanism configured to move the switching gear along the rotational axis direction, the moving mechanism comprising:

a movable member configured to move along a direction perpendicular to the rotational axis direction;

a cam mechanism configured to press the switching gear toward one side in the rotational axis direction of the switching gear by converting, into the rotational axis direction, a direction of a pressing force received from the movable member; and an urging member disposed on a side of the switching gear opposite to the cam mechanism and configured to urge the switching gear toward the cam mechanism, wherein the cam mechanism comprises:

a cam member configured to rotate when pressed by the movable member; and a pressing member configured to press the cam member toward the switching gear by engaging with the cam member that is rotating, wherein the cam member comprises:

a rotatable main body portion;

an operating portion disposed in a position radially separate from a rotational axis of the main body portion and configured to be pressed by the movable member; and a cam-shaped portion disposed in a position radially separate from the rotational axis of the main body portion, on a side of the main body portion opposite to the switching gear, and wherein the cam-shaped portion is formed in a stepped shape to have:

a plurality of slanted surfaces slanted with respect to the rotational axis direction and configured to engage with the pressing member in a rotational direction of the cam member; and a plurality of flat surfaces each formed to extend from a corresponding one of the slanted surfaces along a direction perpendicular to the rotational axis direction and configured to contact the pressing member in the rotational axis direction.

2. The image forming apparatus according to claim 1, wherein the switching gear is configured to move to a third position to restrict the driving force from being transmitted from the driving source to the first transmission mechanism or the second transmission mechanism.

3. The image forming apparatus according to claim 1, wherein the first transmission mechanism is disposed adjacent to the switching gear in a radial direction of the switching mechanism, and the first gear is configured to rotate by the driving force, wherein the second transmission mechanism is disposed adjacent to the switching gear in the radial direction of the switching mechanism, and the second gear is configured to rotate by the driving force, and wherein the gear teeth of the switching gear are configured to:

when in the second position, engage with the gear teeth of the second gear, and disengage from the gear teeth of the first gear in the rotational axis direction.

4. The image forming apparatus according to claim 3, wherein the switching gear is further configured to move to a third position away from the first position and the second position in the rotational axis direction, and disengage from the gear teeth of the first gear and the gear teeth of the second gear in the third position.

5. The image forming apparatus according to claim 3, wherein the drive switching mechanism comprises a moving mechanism configured to move the switching gear along the rotational axis direction, the moving mechanism comprising:

a movable member configured to move along a direction perpendicular to the rotational axis direction;

a cam mechanism configured to press the switching gear toward one side in the rotational axis direction of the switching gear by converting, into the rotational axis direction, a direction of a pressing force received from the movable member; and an urging member disposed on a side of the switching gear opposite to the cam mechanism and configured to urge the switching gear toward the cam mechanism, and wherein at least one of the switching gear and the first gear comprises guide surfaces formed at corner portions of the gear teeth of the at least one of the switching gear and the first gear, the guide surfaces configured to guide the gear teeth of the switching gear to be engaged between the gear teeth of the first gear.

6. The image forming apparatus according to claim 3, wherein the drive switching mechanism comprises a moving mechanism configured to move the switching gear along the rotational axis direction, the moving mechanism comprising:

a movable member configured to move along a direction perpendicular to the rotational axis direction;

a cam mechanism configured to press the switching gear toward one side in the rotational axis direction of the switching gear by converting, into the rotational axis direction, a direction of a pressing force received from the movable member; and an urging member disposed on a side of the switching gear opposite to the cam mechanism and configured to urge the switching gear toward the cam mechanism, and wherein at least one of the switching gear and the second gear comprises guide surfaces formed at corner portions of the gear teeth of the at least one of the switching gear and the second gear, the guide surfaces configured to guide the gear teeth of the switching gear to be engaged between the gear teeth of the second gear.

7. The image forming apparatus according to claim 1, wherein each slanted surface is formed to face toward a downstream side in a rotational direction of the switching gear configured to rotate by the driving force.

8. The image forming apparatus according to claim 3, wherein at least one of the switching gear and the first gear comprises guide surfaces formed at corner portions of the gear teeth of the at least one of the switching gear and the first gear, the guide surfaces configured to guide the gear teeth of the switching gear to be engaged between the gear teeth of the first gear.

9. The image forming apparatus according to claim 3, wherein at least one of the switching gear and the second gear comprises guide surfaces formed at corner portions of the gear teeth of the at least one of the switching gear and the second gear, the guide surfaces configured to guide the gear teeth of the switching gear to be engaged between the gear teeth of the second gear.

10. An image forming apparatus comprising:

a first development roller configured to carry development agent of a first color;

a second development roller configured to carry development agent of a second color;

a driving source;

a first gear having gear teeth and configured to transmit a driving force from the driving source to the first development roller;

a second gear having gear teeth and configured to transmit the driving force from the driving source to the second development roller;

a switching gear having gear teeth and configured to move along a rotational axis direction of the first development roller between a first position to engage the gear teeth of the switching gear with the gear teeth of the first gear and the gear teeth of the second gear, and a second position to engage the gear teeth of the switching gear with the gear teeth of the second gear and disengage the gear teeth of the switching gear from the gear teeth of the first gear;

a movable member configured to move along a direction perpendicular to the rotational axis direction;

an urging member configured to urge the switching gear toward one side in the rotational axis direction;

a cam member configured to rotate when pressed by the movable member, and disposed in a position opposite to the urging member relative to the switching gear; and a pressing member configured to press the cam member toward the switching gear by engaging with the cam member that is rotating in the position opposite to the urging member relative to the switching gear.

11. The image forming apparatus according to claim 10, wherein the switching gear is further configured to move to a third position to disengage the gear teeth of the switching gear from the gear teeth of the first gear and the gear teeth of the second gear, the third position being away from the first position and the second position in the rotational axis direction.

12. The image forming apparatus according to claim 10, wherein the cam member comprises:

a rotatable main body portion;

an operating portion disposed in a position radially separate from a rotational axis of the main body portion and configured to be pressed by the movable member; and a cam-shaped portion disposed in a position radially separate from the rotational axis of the main body portion, on a side of the main body portion opposite to the switching gear, and wherein the cam-shaped portion is formed in a stepped shape to have:

a plurality of slanted surfaces slanted with respect to the rotational axis direction and configured to engage with the pressing member in a rotational direction of the cam member; and a plurality of flat surfaces each formed to extend from a corresponding one of the slanted surfaces along a direction perpendicular to the rotational axis direction and configured to contact the pressing member in the rotational axis direction.

13. The image forming apparatus according to claim 12, wherein each slanted surface is formed to face toward a downstream side in a rotational direction of the switching gear configured to rotate by the driving force.

14. The image forming apparatus according to claim 10, wherein at least one of the switching gear and the first gear comprises guide surfaces formed at corner portions of the gear teeth of the at least one of the switching gear and the first gear, the guide surfaces configured to guide the gear teeth of the switching gear to be engaged between the gear teeth of the first gear.

15. The image forming apparatus according to claim 10, wherein at least one of the switching gear and the second gear comprises guide surfaces formed at corner portions of the gear teeth of the at least one of the switching gear and the second gear, the guide surfaces configured to guide the gear teeth of the switching gear to be engaged between the gear teeth of the second gear.

* * * * *